US006213011B1

(12) United States Patent
Dubuit

(10) Patent No.: US 6,213,011 B1
(45) Date of Patent: Apr. 10, 2001

(54) LOADING AND OFFLOADING SYSTEMS FOR PRINTING MACHINE

(75) Inventor: Jean-Louis Dubuit, Paris (FR)

(73) Assignee: Societe D'Exploitation des Machines Dubuit, Noisy le Grand (FR)

( * ) Notice: Subject to any disclaimer, the term of this patent is extended or adjusted under 35 U.S.C. 154(b) by 0 days.

(21) Appl. No.: 09/349,252

(22) Filed: Jul. 8, 1999

(30) Foreign Application Priority Data

Jul. 10, 1998 (FR) ..... 98 08913

(51) Int. Cl.[7] ..... B41F 17/00

(52) U.S. Cl. ..... 101/35; 101/37; 101/40.1; 101/44; 198/418.6; 414/752

(58) Field of Search ..... 101/35, 38.1, 39, 101/40, 40.1, 43, 44; 198/373, 374, 375, 376, 378, 379, 392, 407, 418.6, 418.7, 620, 621.1; 414/431, 589, 749, 751, 752, 757

(56) References Cited

U.S. PATENT DOCUMENTS 4,452,350 * 6/1984 Shields ..... 198/424
5,282,715 * 2/1994 Abbate et al. ..... 414/757
5,520,106 * 5/1996 Karlyn et al. ..... 101/35
5,520,107 * 5/1996 Airoldi ..... 101/35
5,730,048 3/1998 Averill et al. .

FOREIGN PATENT DOCUMENTS 297 17 139 3/1998 (DE) .

* cited by examiner

*Primary Examiner*—Ren Yan
(74) *Attorney, Agent, or Firm*—Young & Thompson

(57) ABSTRACT

A printing machine includes a printing table for printing groups of objects presented in an entry support and an exit support, a transfer system disposed between the printing table and a loading system, on the one hand, and an offloading system, on the other hand. The transfer system transfers the objects one by one. The loading and offloading systems include holding arrangements which take up simultaneously and move a group of objects between the entry support or the exit support and the intermediate supports. The intermediate supports support the group of objects disposed with a predetermined spacing. Spacing modification arrangements modify the spacing of the group of objects from an entry spacing to the predetermined spacing or from the predetermined spacing to an exit spacing. The transfer system transfers the objects between the printing table and the intermediate supports.

22 Claims, 4 Drawing Sheets

LOADING AND OFFLOADING SYSTEMS FOR PRINTING MACHINE

BACKGROUND OF THE INVENTION

1. Field of the Invention

The present invention concerns a loading system and an offloading system for a printing table.

It generally concerns the loading of objects presented as groups of objects in an entry support. The objects are taken from their entry support for printing one by one on a printing table.

It also concerns, in a symmetrical manner, the offloading of such objects after printing them to enable a new disposition in groups in an exit support.

2. Description of the Prior Art

In printing machines, the printing table co-operates with a transfer system which puts objects to be printed down one by one on the printing table and then picks them up one by one. This transfer system co-operates in turn with a loading system and an offloading system which respectively present the objects to be printed and recover the printed objects.

The production rate of a printing machine of the above kind depends on that of the transfer system associated with the loading and offloading systems.

To avoid reducing the rate of production, it is therefore essential for the loading and offloading systems to be able to present and recover the objects at a high rate which is relatively close to the printing rate of the printing table.

An aim of the present invention is to propose loading and offloading systems which in particular enable a good rate of production to be maintained.

SUMMARY OF THE INVENTION

In accordance with the invention, a system for loading a printing table with objects presented in groups in an entry support, the objects of the group being distributed with an entry spacing, and the printing table co-operating with a transfer system disposed between the printing table and the loading system, the transfer system being adapted to transfer the objects one by one from the loading system onto the printing table, includes an intermediate support adapted to support the group of objects disposed with a predetermined spacing, holding means adapted to take up simultaneously and to move a group of objects between the entry support and the intermediate support, and spacing modification means adapted to modify the spacing of the group of objects from the entry spacing to the predetermined spacing, the transfer system being adapted to transfer the objects onto the printing table from the intermediate support.

Accordingly, by using an intermediate support between the entry support and the transfer system the objects can be disposed with a predetermined spacing and in accordance with a disposition suitable for the transfer system to take them up.

The invention solves the problem of positioning the objects on the intermediate support by means of the holding means and the spacing modification means which enable the objects to be placed correctly on the intermediate support. Taking the objects in groups to place them on the intermediate support eliminates the constraint of the limit on the speed at which the objects can be moved from the entry support to the intermediate support, as it were. The rate of operation of the holding means and the spacing modification means is equal to a sub-multiple of the rate of operation of the transfer system. To be more precise, the rate of operation of the holding means and the spacing modification means is equal to the operating rate of the transfer system divided by the number of objects in the group of objects.

The loading system in accordance with the invention therefore eliminates the constraints of positioning the objects in the entry support and the constraints of the limit on the speed of the holding means and the spacing modification means necessary for correct positioning of the objects before they are taken up by the transfer system.

In a preferred version of the invention, the holding means include separate holding members adapted to take respective objects from the group of objects and to move between the entry support and the intermediate support in co-operation with the spacing modification means.

By using separate holding members for the objects of the same group it is possible to modify the spacing of the objects, i.e. the distance between the objects, while the objects are being moved toward the intermediate support, which represents a time saving which also improves the rate of transfer of the objects.

According to an advantageous feature, which provides for relatively simple co-operation of the holding means and the spacing modification means, the spacing modification means include guide grooves adapted to guide the respective separate holding members and the guide grooves have intersecting directions in a common plane.

In another preferred version of the invention, the holding means include at least one clamp adapted to grasp the group of objects, the objects are presented in a vertical position in the entry support, and the clamp is adapted to move the group of objects from the vertical position to a horizontal position.

The clamp simultaneously modifies the position of the objects in the same group to place them in a horizontal position, which is the position in which they are processed on the printing table.

A holding clamp of the above kind also eliminates constraints associated with the position of the objects in their entry support.

In accordance with another preferred feature of the invention, the intermediate support includes a circular contour turntable adapted to rotate stepwise and comprising a series of support members for the objects disposed along the circular contour turn-table at a spacing equal to the predetermined spacing.

An intermediate support of the above kind provides a simple way of presenting the objects to the transfer system continuously, by stepwise rotation of the circular contour turntable.

In this case, and in an advantageous version that facilitates subsequent centering of the objects to be printed, the holding means co-operate with orientation means adapted to orient the objects during their movement toward the intermediate support so that the objects are placed on respective support members with the same orientation relative to the center of rotation of the circular contour turntable.

In another advantageous version, if the intermediate support comprises a circular contour turntable, the printing table and the transfer system are adapted to rotate stepwise and drive means are adapted to drive their stepwise rotation synchronously with the printing table, the transfer system and the intermediate support.

Synchronized driving of the various members provides a simple way of loading the printing machine continuously.

In accordance with an analogous aspect of the present invention, a system for offloading from a printing table objects presented in groups and distributed with an exit spacing in an exit support, the printing table co-operating with a transfer system disposed between the printing table and the offloading system, the transfer system being adapted to transfer the objects one by one from the printing table to the offloading system, includes an intermediate support adapted to support the group of objects disposed with a predetermined spacing, holding means adapted to take up simultaneously and to move a group of objects between the intermediate support and the exit support and spacing modification means adapted to modify the spacing of the group of objects from the predetermined spacing to the exit spacing, the transfer system being adapted to transfer the objects from the printing table to the intermediate support.

In a manner that is symmetrical with respect to the loading system in accordance with the first aspect of the invention, and using an intermediate support between the exit support and the transfer system, an offloading system of the above kind disposes the objects with a predetermined spacing and in a disposition suitable for their transfer by the transfer system. The objects are positioned on the exit support by the holding means and the spacing modification means which enable the objects to be placed correctly on the exit support. Placing the objects on the exit support in groups eliminates the constraint of the limit on the speed of movement of the objects from the intermediate support toward the exit support. The rate of operation of the holding means and the spacing modification means is equal to a sub-multiple of the rate of operation of the transfer system. To be more precise, the rate of operation of the holding means and the spacing modification means is equal to the rate of operation of the transfer system divided by the number of objects in the group of objects.

The offloading system of the invention therefore eliminates constraints associated with positioning of the objects in the exit support and the constraints of the limit on the speed of the holding means and the spacing modification means necessary for proper positioning of the objects in the exit support.

In a preferred version of this analogous aspect of the invention, the holding means include separate holding members adapted to take respective objects from the group and to move between the intermediate support and the exit support in co-operation with the spacing modification means.

By using separate holding members for the objects of the same group, the spacing of the objects can be modified while the objects are moving toward the exit support, which represents a time saving which also improves the rate of transfer of the objects.

In an advantageous version of the invention, which simplifies co-operation of the holding means and the spacing modification means, the spacing modification means include guide grooves adapted to guide the respective separate holding members and the guide grooves are disposed in intersecting directions in a common plane.

In another preferred version of this analogous aspect of the invention, the holding means include at least one clamp adapted to grasp the group of objects, the objects are presented in a horizontal position, the clamp is adapted to move the group of objects from the horizontal position toward a vertical position, and the objects are presented in the vertical position in the exit support.

The clamp enables the position of the objects in the same group to be modified simultaneously in order to place them in a vertical position in their exit support.

In accordance with another preferred feature of this analogous aspect of the invention, the intermediate support includes a circular contour turntable adapted to rotate stepwise and comprising a series of support members for the objects disposed along the circular contour turn-table at a spacing equal to the predetermined spacing.

An intermediate support of the above kind provides a simple way to take up the objects continuously from the transfer system by stepwise rotation of the circular contour turntable.

In this case, and in an advantageous version which facilitates subsequent positioning of the objects to be disposed in the exit support, the holding means cooperate with orientation means adapted to orient the objects during their movement toward the exit support so that the objects are placed on the exit support with the same orientation.

In another preferred version of this analogous aspect of the invention, independent drive means are adapted to drive the stepwise rotation of the intermediate support, the rotation causes the support members to move in succession to a transfer station to which the transfer system is adapted to transfer an object, and a sensor senses an object on the support member at the transfer station and co-operates with the independent drive means so that the intermediate support turntable is driven in rotation only if the sensor senses an object on the support member at the transfer station.

Independent driving of the rotation of the intermediate support in this way, under the control of a sensor sensing an object, guarantees that all the adjoining support members are actually supporting an object so that complete groups of objects can be formed at the exit from the intermediate support by taking up the objects on a group of adjoining support members.

This disposition is particularly advantageous if objects are lost or removed while printing them on the printing table or if the printing table is not fed regularly with objects to be printed.

In a further preferred version of this analogous aspect of the invention, which also guarantees that the holding means actually take up complete groups of objects, the rotation of the intermediate support causes the support members to move successively to exit stations, the number of exit stations being equal to the number of objects in a group of objects, sensors sense objects on the support members at the exit stations and co-operate with drive means for the holding means so that the holding means take a group of objects placed on the support members at exit stations only if the sensors sense an object on each support member at the exit stations.

In accordance with the invention, the loading system and the offloading system are particularly well suited to co-operate with a printing table if the objects are screens of the type equipping a liquid crystal or similar display system.

In accordance with a third aspect of the invention, a printing machine for objects presented in groups in entry and exit supports is characterized in that it includes a loading system and an offloading system in accordance with the invention.

A machine of this kind can print objects and package them at the exit in a similar manner to how they are packaged at the entry, possibly in identical entry and exit supports.

Other features and advantages of the invention will become apparent in the course of the following description, which is given by way of non-limiting example and with reference to the accompanying drawings.

DETAILED DESCRIPTION OF THE PREFERRED EMBODIMENTS

Figure 1:
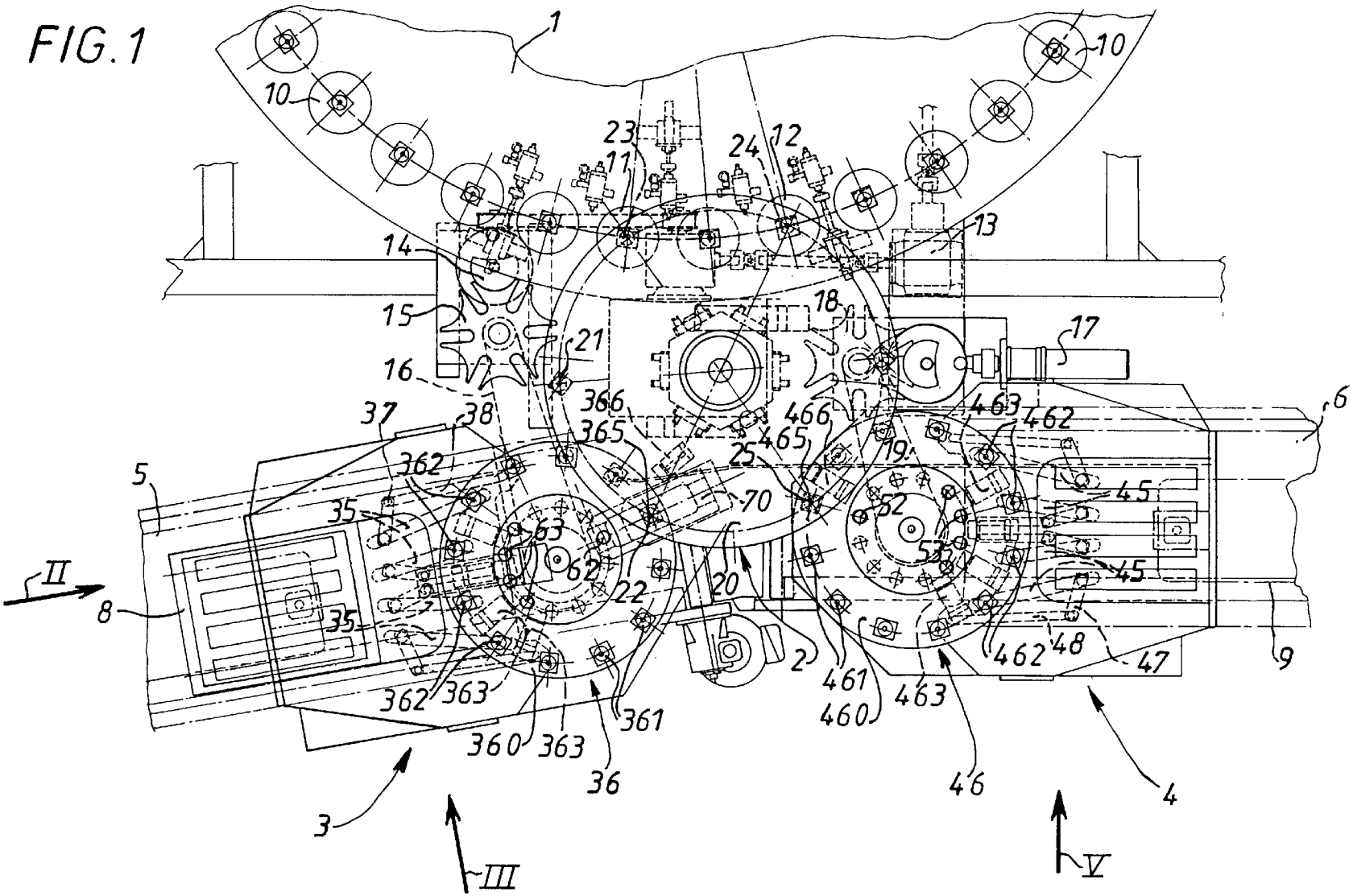
FIG. 1 is a plan view of a printing machine in accordance with one aspect of the invention.

One embodiment of a printing machine in accordance with the invention is described below with reference to FIG. 1.

A machine of this kind generally comprises a printing table 1, a transfer system 2, a loading system 3 and an offloading system 4.

An entry conveyor 5 conveys the objects to be printed to the vicinity of the loading system 3. In a symmetrical fashion, an exit conveyor 6 takes up the objects downstream of the offloading system 4.

A machine of the above kind is suitable for printing objects 7 (see FIG. 3, for example) presented in the form of groups of objects 7 at the entry and at the exit in entry supports 8 and exit supports 9.

By way of non-limiting example, the objects can be screens for a display system as routinely used in portable telephones. More generally, the objects can be in the form of flat parts with small dimensions (a few centimeters on each side) and made from a synthetic material, for example a transparent plastics material. Because of their dimensions and the material from which they are made, such parts are relatively fragile and difficult to handle.

During their manufacture, the parts 7 are routinely presented in supports which package them in groups in a plurality of rows. The entry supports 8 and exit supports 9 are typically thermoformed trays in the bottom of which locations for positioning the various flat parts 7 are formed. To save space in packaging them, the parts 7 are generally disposed vertically in the entry supports 8 and exit supports 9.

The printing table 1 has a circular contour. It includes a plurality of object stations 10 regularly distributed at its periphery and each adapted to receive one object 7 to be printed. The table 1, part of which is shown in FIG. 1, is adapted to rotate stepwise about a vertical rotation axis. This rotation moves the object stations 10 to a loading station 11, various workstations (not shown) in which the objects 7 are printed, and an offloading station 12.

The printing table 1 co-operates with the transfer system 2 to transfer the objects 7 one by one. The transfer system 2 is also in the form of a turntable 20 adapted to rotate stepwise. It includes take-up members 21, of which there are six in this example, regularly distributed along the periphery of the transfer system.

The rotation of the transfer system 2 moves the take-up members 21 to a take-up station 22 facing the loading system 3, to a station 23 feeding the printing table and facing the loading station 11 of the printing table 1, to a take-up station 24 facing the offloading station 12 of the printing table 1 and to a release station 25 facing the offloading system 4.

Figure 2:
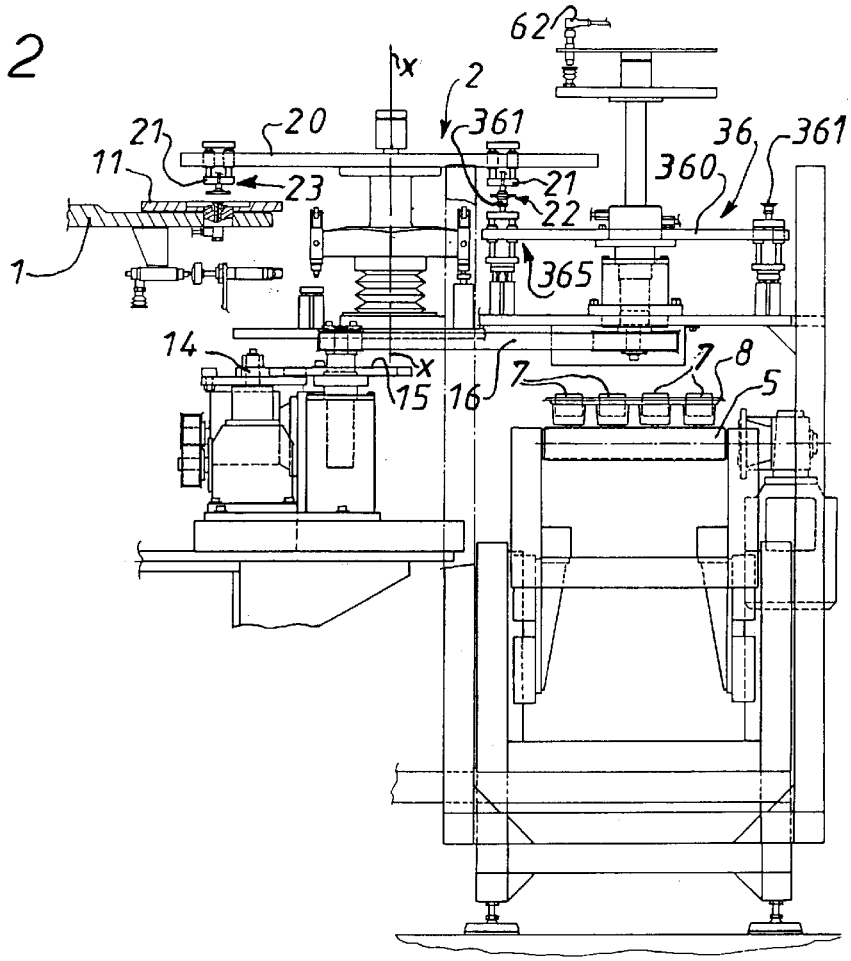
FIG. 2 is a partial elevation view of the machine from FIG. 1, as seen from the loading system side.

As shown in FIG. 2, the turntable 20 of the transfer system 2 lies in a horizontal plane above the printing table 1 and the loading system 3. Likewise it lies above the offloading system 4. In addition to its stepwise rotation, the turntable 20 also moves in vertical translation, parallel to its rotation axis X—X, when the take-up members 21 are respectively in their take-up stations 22, feed stations 23, take-up stations 24 and release stations 25. The turntable 20 therefore reciprocates between a low position and a high position on each rotation step, so that the flat parts 7 to be transferred are taken up or put down at each of the aforementioned stations of the transfer system 2.

In this example, the take-up members 21 are suction nozzles connected in a conventional way to a vacuum pump by a pneumatic circuit. These suction nozzles are very suitable for transporting the flat parts 7 by suction.

The structure of the loading system 3 and the offloading system 4 in one embodiment of the present invention will now be described. The structures of the systems are substantially identical and they are symmetrically disposed about the transfer system 2.

Figure 3:
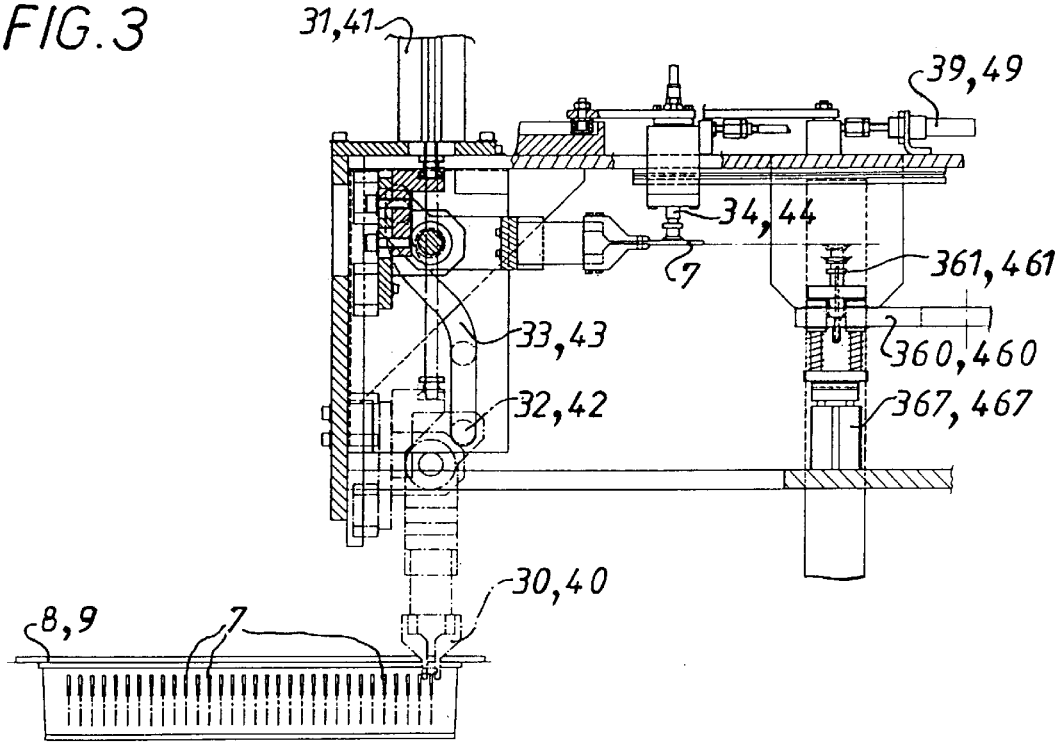
FIG. 3 is a diagrammatic view showing one embodiment of the holding means of a loading or offloading system of the invention.

In this example, as seen most clearly in FIG. 3, the flat parts 7 are disposed vertically in the entry supports 8 and exit supports 9, in rows each comprising four parts 7 (see FIG. 1).

The loading system 3 and offloading system 4 include clamps 30, 40 for grasping the flat parts 7 and moving the parts 7 between a vertical position shown in dashed line and a horizontal position shown in continuous line in FIG. 3.

The number of clamps 30, 40 is preferably equal to the number of parts 7 in each group in order to take up the latter individually and simultaneously. Thus in this example there are four clamps.

The clamps 30, 40 are mounted on respective piston rods 31, 41 which reciprocate them vertically. The clamps 30, 40 are also associated with rollers 32, 12 which move in guide grooves 33, 43. The guide grooves 33, 43 define a curved path enabling each clamp 30, 40 associated with the rollers 32, 42 to pivot through one quarter-turn. The vertical movement of the clamps 30, 40 associated with the pivoting of the rollers 32, 42 moves the clamps between the vertical position and the horizontal position.

The loading system 3 and offloading system 4 further include suction nozzles 34, 44 similar to the take-up members 21 of the transfer system 2 and which form separate holding members, the number of which is equal to the number of parts 7 in each group.

The separate holding members 34, 44 in each loading system 3 and offloading system 4 are adapted to move the objects 7 in co-operation with spacing modification means 35, 45 between an intermediate support 36, 46 described below and clamps 30, 40.

Figure 4:
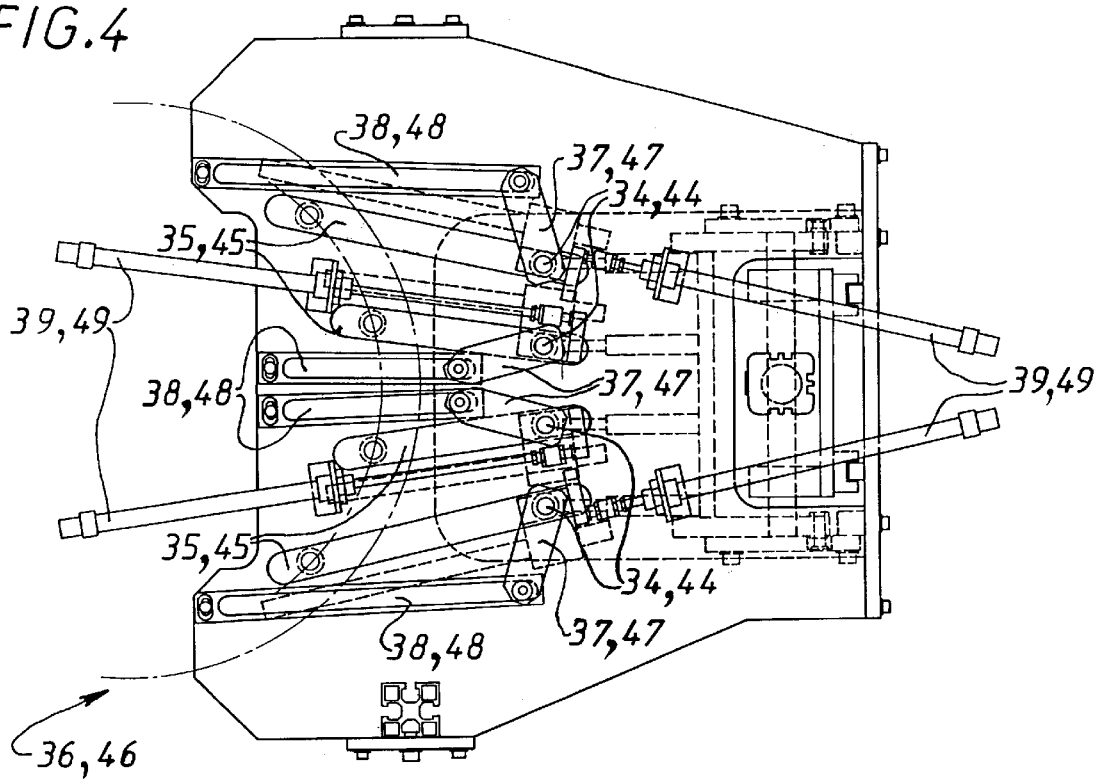
FIG. 4 is a partial plan view of a loading cr offloading system of the machine shown in FIG. 1.

In this example, and as shown in FIG. 4, the spacing modification means include guide grooves 35, 45 disposed in intersecting directions in the same horizontal plane. In this example, in which the entry spacing between the objects 7 of the same group in the entry support 8 is less than the spacing of the objects placed on the intermediate support 36, the guide grooves 35 of the loading system 3 extend toward the intermediate support 36 in respective diverging directions (see FIG. 1).

In a symmetrical fashion, the exit spacing between the objects 7 in the same row in the exit support 9 being less than the spacing of the objects on the intermediate support 46 of the offloading system 4, the guide grooves 45 of the offloading system 4 extend toward the intermediate support 46 in respective diverging directions.

The suction nozzles 34, 44 are adapted to slide in the respective guide grooves 35, 45 with a horizontal reciprocating movement between the clamps 30, 40 and the intermediate support 36, 46. This reciprocating movement can be conventionally produced by pneumatic jacks 39, 49 associated with each suction nozzle 34, 44. The latter are mounted on a circuit connected to a vacuum pump and used to pick up the objects 7 by suction.

Figure 6:
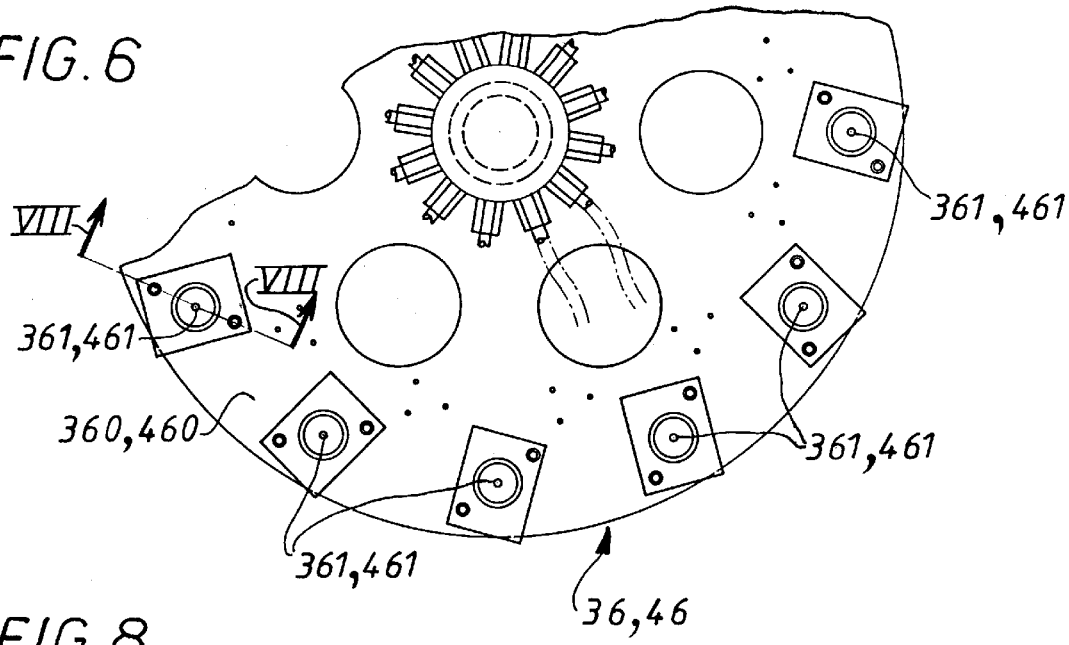
FIGS. 6 and 7 are respectively partial top and bottom views of an intermediate support of a loading or offloading system constituting one embodiment of the invention.

As shown in FIG. 6, the intermediate support 36, 46 includes a circular contour turntable 360, 460 which rotates stepwise about a vertical rotation axis. It includes a series of support members 361, 461 adapted to support the objects 7. The support members 361, 461 are disposed along the circular contour of the turntable 360, 460 at a predetermined regular spacing.

The stepwise rotation of the intermediate support 36 of the loading system 3 moves the support members 361. to entry stations 362 facing the separate holding members 34 when the latter are at one end of the guide grooves 35. obviously, the number of entry stations 362 is equal to the number of objects 7 in each group.

In a symmetrical fashion, the stepwise rotation of the intermediate support 46 of the offloading system 4 moves the support members 461 to exit stations 462 facing the separate holding members 44 when the latter are at one end of the guide grooves 45. The number of exit stations 462 is equal to the number of objects 7 in each group to be placed in the exit support 9.

In this embodiment the guide grooves 35, 45 are different lengths so that the objects 7 of the same group are moved between a position in which they are aligned in the entry support 8 or the exit support 9 and a position in which they are arranged along a circular arc facing the support members 361, 461 at the entry stations 362 of the intermediate support 36 of the loading system 3 or the exit stations 462 of the intermediate support 46 of the offloading system 4.

The suction nozzles 34 of the holding members preferably co-operate with orientation means 37, 38, 47, 48 to orient the objects while they are moving, as shown in more detail in FIG. 4.

To perform this orientation, in this particular embodiment, each suction nozzle 34, 44 is mounted at the end of a bar 37, 47 whose other end is adapted to slide in a second guide groove 38, 48 associated with the guide groove 35, 45 in which the suction nozzle 34, 44 slides. The two guide grooves 35, 45 and 38, 48 are disposed in non-parallel directions so that sliding of the bar 37, 47 in the associated two grooves 35, 45 and 38, 48 is accompanied by relative rotation about the end sliding in said second guide groove 38, 48 to modify the orientation of the suction nozzle 34, 44 sliding in the first guide groove 35, 45.

The objects 7 are thus placed on the support members 361 of the intermediate support 36 of the loading system 3 with the same orientation relative to the rotation center of the turntable 360 of the intermediate support 36 and the objects 7 are placed in the exit support 9 with the same orientation on leaving the offloading system 4.

The support members 361, 461 of the intermediate supports 36, 46 are preferably also suction nozzles 361, 461.

In this example, and as shown in FIG. 3, the turntable 360, 460 of the intermediate support 36, 46 of the loading and offloading systems 3 and 4 lies in a horizontal plane under the horizontal plane in which the suction nozzles 34, 44 of the holding members move. At the entry or exit stations 362, 462 of the intermediate support 36, 46, the support members 361, 461 are reciprocated vertically to come close to the holding members 34, 44 so that the objects 7 are transferred at the entry or exit stations 362 or 462 by suction applied alternately to one face or the other of each object.

Figure 8:
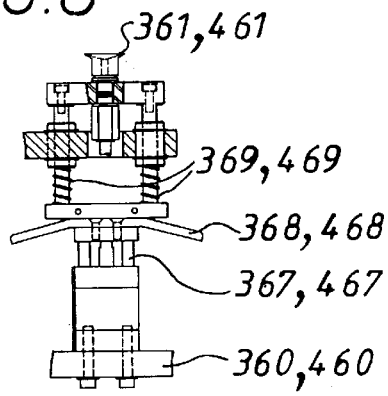
FIG. 8 is a partial view in section taken along the line VIII—VIII in FIG. 6.

As shown in detail in FIG. 8, this reciprocating movement can be produced by a jack 367, 467 at each entry or exit station 362, 462 of the intermediate support 36, 46, for example. The upward movement of the support member 361, 461 is shown in FIG. 3, for example, in which the support member 361, 461 is shown in dashed outline in its high position.

A guide plate 368, 468 facilitates positioning the support members 361, 461 above the jacks 367, 467 on each rotation of the turntable 360, 460. The guide turntable 368, 468 fixed to the jack 367, 467 defines an upward and then downward path on the circular path of movement of the support members 361, 461 on stepwise rotation of the turntable 360, 460.

The support members 368, 468 are further adapted to be spring-loaded into a low position by return spring means such as springs 369, 469.

Figure 7:
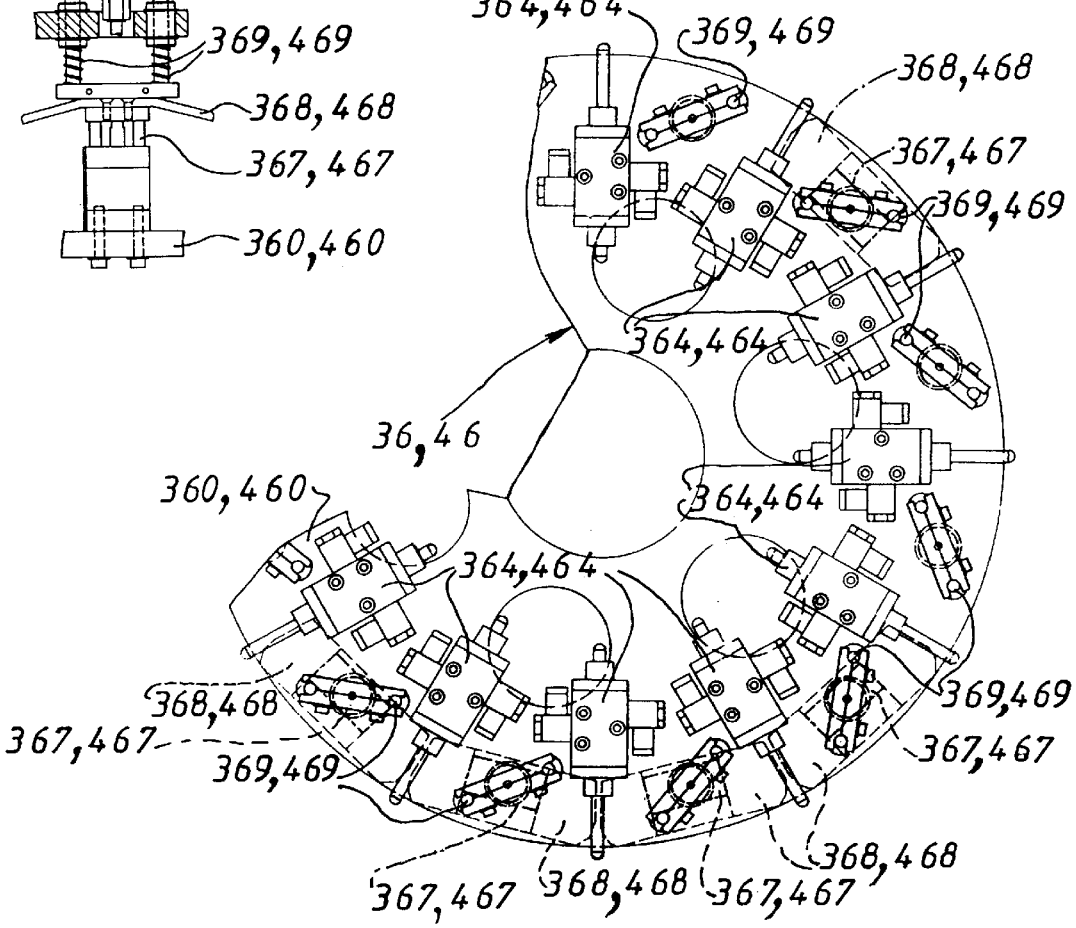

Furthermore, each entry or exit station 362, 462 is also associated with a jack 363, 463 adapted to actuate switches 364, 464 mounted on the pneumatic circuit of the suction nozzles 361, 461 (see FIG. 7) so that the suction nozzles 361, 461 are connected to the vacuum pump when they are in the entry stations 362 and disconnected when they are in the exit stations 462.

The intermediate support 36 of the loading system 3 further includes a transfer station 365 facing the take-up station 22 of the transfer system at which each object is taken up by the transfer system 2.

In a similar manner, the intermediate support 46 of the offloading system 4 includes a transfer station 465 facing the release station 25 of the transfer system 2 at which each object 7 is taken up by the intermediate support 46.

Figure 5:
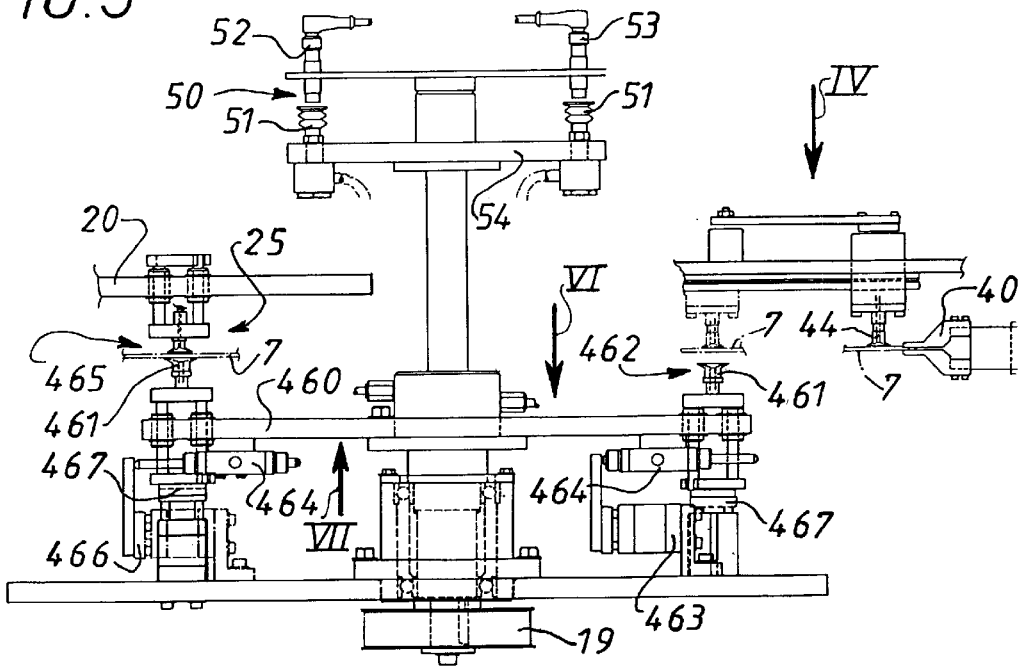
FIG. 5 is an elevation view to a larger scale showing a detail of the offloading system from the machine shown in FIG. 1.

As shown in FIG. 2 for the loading system 3 and in FIG. 5 for the offloading system 4, a jack 367, 467 identical to the jacks of the entry or exit stations 362, 462 is provided at the transfer station 365, 465 to raise the support member 361, 461 toward the take-up member 21 of the transfer system 2. A cam 368, 468 likewise facilitates positioning the support members 361, 461 on the jack 367, 467 of the transfer station 365, 465 on each rotation of the turntable 360, 460 of the intermediate support 36, 46.

As shown in FIG. 1, a jack 366, 466 at the transfer station 365, 465 actuates the switches 364, 464 associated with each suction nozzle 361, 461 to disconnect the suction nozzles 361 from the pneumatic circuit and thereby to cut off the suction by the vacuum pump which holds the objects onto each support member 361 of the intermediate support 36 in the case of the loading system 3 and connects the suction nozzles 461 to a vacuum pump on the pneumatic circuit to enable the objects to be held by suction on each support member 461 of the intermediate support 46 in the case of the offloading system 4.

A centering system 70 can be provided at the transfer station 365 of the loading system 3 to perfect the position of each object 7 before it is transferred onto the printing table 1. This type of centering system is well known in itself and is not described in detail here. It can conventionally comprise two jaws whose inside contour in the closed position is identical to the contour of the object 7, so that each jaw closes around the object 7.

Conventional drive means 13, 14, 15 which are not described in detail here drive the synchronized stepwise rotation of the printing table 1, the turntable 20 of the transfer system 2 and the turntable 360 of the intermediate support 36 of the loading system 3. A direction changer 13, for example, connects a shaft of the indexing system of the printing table 1 to a shaft line that drives a Maltese cross 15 associated with a roller system 14 to rotate the intermediate support 36 stepwise via a transmission belt 16.

Drive means 17, 18, 19 are provided for the offloading system and are independent of those driving rotation of the printing table 1 and the transfer system 2. They drive stepwise rotation of the intermediate support and comprise, for example, a motor 17 associated with a Maltese cross 18 driving stepwise rotation of the turntable 460 of the intermediate support 46 via a transmission chain 19.

Sensor means 50 controlling rotation of the turntable 460 of the intermediate support 46 of the offloading system 4 will now be described.

As shown in FIG. 5, a sensor 51, 52 sensing an object on the support member 461 at the transfer station 465 co-operates with the independent drive means 17, 18, 19 so that the turntable 460 of the intermediate support 46 is rotated only if the sensor 51, 52 senses an object 7 on the support member 461 at the transfer station 465. This prevents any of the support members 461 remaining empty, which would produce incomplete groups of objects at the exit from the intermediate support 46.

The sensor 51, 52 can be mounted on the pneumatic circuit and include, for example, bellows 51 each associated with the pneumatic circuit of one of the circuit members 461 and adapted to deform according to the status of the pneumatic circuit, which is closed if there is an object 7 on the support member 461 or open if there is no object 7 on the support member 461. The bellows 51 are mounted on a sensor plate 54 constrained to rotate with the turntable 460 of the intermediate support 46. The number of bellows 51 is therefore the same as the number of support members 461 and the rotation of the sensor plate 54 causes the bellows 51 to pass under a displacement sensor 52 which senses the movement of the bellows 51, which varies according to the open or closed status of the pneumatic circuit on which they are mounted. The displacement sensor 52 is at a fixed position determined so that each bellows 51 coming face to face with the displacement sensor 52 is the one associated with the support member 461 which is then positioned at the transfer station 465. The motor 17 of the means driving rotation of the intermediate support 46 is therefore under the control of the displacement sensor 52. A sensor 51, 52 of this kind and its operation are described in detail in the Applicant's French patent application No. 96 06797, the content of which is hereby incorporated in this description by reference.

In a similar manner, sensors 51, 53 sensing objects on the support members 461 at the exit stations 462 co-operate with drive means, here the jacks 41 and 49, of the holding means 40, 44 so that the holding means take up a group of objects 7 placed on the support members 461 only if the sensors 51, 53 sense an object 7 on each support member 461 at the exit stations 462.

The sensors 51, 53 consist of the same bellows 51 as those described above and displacement sensors 53 in fixed positions above the sensor plate 54, said positions corresponding for each rotation step to the positions of the bellows 51 associated with the support members 461 at the exit stations 462.

The number of displacement sensors 53 is preferably equal to the number of exit stations 462, which is four in this example.

In this example, the sensor means 50 comprise a plate 54, bellows 51, a displacement sensor 52 and four displacement sensors 53 and could naturally include other displacement sensors for driving or monitoring the operation of the offloading system 4.

Furthermore, identical sensor means could be associated with the intermediate supports 36 of the loading system 3. Accordingly, as shown in FIGS. 1 and 2, a displacement sensor 62 associated with bellows 61 can sense an object 7 on the support member 361 at the transfer station 365 and control the operation of the centering system 70, for example, so that it operates only when there is an object 7 on this member.

Similarly, displacement sensors 63 can be adapted to sense an object on the support members 361 at the respective input stations 462, for example to count the parts introduced into the printing machine.

The operation of the printing machine will now be described.

The objects 7 in the entry support 8 advance stepwise on the conveyor 5 under the clamps 30 which are initially vertical. The clamps 30 grasp the objects and are then raised and pivoted to present the objects 7 horizontally. During this movement of the clamps 30, the suction nozzles 34 of the holding means are standing by at one end of the guide grooves 35, substantially in line with the clamps 30. They are adapted to take up by suction the group of objects 7 placed in the horizontal position by the clamps 30. The clamps 30 then open to release the objects. The suction nozzles 34 then move in the guide grooves 35, in association with the bars 37, and at the end of their stroke locate in the guide grooves 35, opposite entry stations 362 of the intermediate support 36, simultaneously orienting the objects relative to the center of the turntable 360 of the intermediate support 36.

The support members 361 at the entry stations 362 are raised by the jacks 367 to pick up the objects 7 by suction, applied to their bottom face in this position, and the jacks 363 actuate the switches 364 to connect the suction nozzles of the support members 361 to the vacuum. pump in the pneumatic circuit. The objects 7 are therefore supported by the support members 361 and the rotation of the turntable 360 moves the objects 7 stepwise toward the transfer station 365.

During this time, the clamps 30 move to a vertical. position to grasp a new group of objects 7 and the suction nozzles 34 of the holding means are moved in the opposite direction in the guide grooves 35 and return to their original position substantially in line with the clamps 30.

At the transfer station 365, and on each rotation of the transfer system 2, the turntable 20 of the latter is lowered and a take-up unit 21 takes up by suction the objects 7 at the transfer station 365. Simultaneously, at the transfer station, the jack 367 pushes the support member 361 up toward the take-up member 21. This high position is shown in FIG. 2 at the transfer station 365 in particular. At the same time, the jack 366 disconnects the vacuum from the suction nozzle of the support member 361 at the transfer station 365. The object 7, which is no longer held onto the support member 361 by suction, is then taken up by suction by the take-up member 21 and is then moved stepwise by the transfer system 2 toward the printing table 1.

The object 7 is then fed in the conventional way to a loading station 11 of the printing table 1 and printed.

Afterward, it is taken up by a take-up member 21 of the transfer system at the offloading station 12 of the printing table and is moved to the release station 25 facing the intermediate support 46 of the loading system.

The associated jack 467 lowers the turntable 20 and raises the support member 461 to bring the object 7 into contact with the support member 461 and the transfer station 465 of the intermediate support 46. Simultaneously, the jack 466 associated with the support member 461 actuates the switch 464 to connect the suction nozzle of the support member 461 to the vacuum pump to enable the object to be picked up by the intermediate support 46.

If there is an object on the support member, the sensor 51, 52 enables the turntable 460 to rotate one step to receive the next object. On the other hand, if no object has been put down, the turntable 460 does not move but the printing table 1 and the turntable 20 of the transfer system 2 rotate one step.

At the exit stations 462 of the intermediate support 46, if the sensors 53 sense four objects on the support members 461 at the respective four exit stations, the support members 461 are moved vertically upward by the jacks 467 toward the suction nozzles 44 of the holding members and the jacks 463 disconnect the support members 461 from the vacuum pump so that the suction nozzles 44 take up the objects by suction on an opposite side, the top side in this position. The nozzles are then moved in guide grooves 45, each associated with a bar 47 mounted in a guide groove 48, toward the clamps 40 which are standing by in a horizontal position.

At the end of the stroke of the suction nozzles 44 the objects are aligned with the same orientation. The clamps 40 then grasp the group of objects presented in the horizontal position by the suction nozzles 44. The objects grasped by the clamps 40 are moved downward, simultaneously rotating through one quarter-turn so that they are positioned vertically in the exit support 9. When the objects are in place in the exit support 9 the clamps 40 return to their horizontal position to take up a new group of objects 7.

The exit support 9 then moves forward one step on the exit conveyor 6 to enable the clamps to receive the next group of objects.

Clearly the clamps 30, 40 and the nozzles 34, 44 of the holding members perform one to-and-fro movement while the turntable 360 of the intermediate support 36, the turntable 20 of the transfer system 2, the printing table 1 and where applicable the turntable 460 of the intermediate support 46 of the offloading system 4 rotate through four indexing steps.

The objects 7 can therefore be loaded and offloaded in accordance with the invention without slowing the rate of production of the printing machine, which can be as high as 3 600 printed objects per hour.

Of course, many modifications can be made to the examples described above without departing from the scope of the invention.

Thus the printing machine may comprise only a loading system in accordance with the invention at its entry, the objects exiting in any manner, or the printing machine can include only an offloading system, the objects entering differently.

The clamps of the holding members described in the above example could equally be replaced by a single clamp adapted to grasp a group of objects.

Furthermore, the objects can be presented in a horizontal position at the entry, respectively at the exit, so that the clamps for modifying the position of the objects can be dispensed with, only suction nozzles moving in a horizontal plane and co-operating with spacing modification means able to move the objects between the intermediate support and the entry, respectively exit, support.

What is claimed is:

1. A machine for printing grouped objects comprising:

a printing table;

a transfer system;

a loading system for loading grouped objects, presented at an entry spacing, from an entry support to said transfer system which transfer system in turn transfers each of the grouped objects onto said printing table, said loading system comprising:

an intermediate support adapted to support the grouped objects with a predetermined spacing;

holding means for simultaneously taking up each of the grouped objects and moving the grouped objects between the entry support and said intermediate support; and spacing modification means for modifying the spacing of the grouped objects from the entry spacing to the predetermined spacing; and an offloading system for offloading grouped objects, presented at an exit spacing, to an exit support from said transfer system which transfer system in turn transfers each of the grouped objects from said printing table, said offloading system comprising:

an intermediate support adapted to support the grouped objects with a predetermined spacing;

holding means for simultaneously taking up each of the grouped objects and moving the grouped objects between said intermediate support and the exit support; and spacing modification means for modifying the spacing of the grouped objects from the predetermined spacing to the exit spacing.

2. The machine claimed in claim 1 wherein said printing table and said transfer system are adapted to rotate stepwise and further comprising drive means adapted to drive synchronized stepwise rotation of said printing table, said transfer system and said intermediate support of said loading system.

3. A loading system for loading grouped objects, presented at an entry spacing, from an entry support to a transfer system which transfer system in turn transfers each of the grouped objects onto a printing table, said loading system comprising:

an intermediate support adapted to support the grouped objects with a predetermined spacing;

holding means for simultaneously taking up each of the grouped objects and moving the grouped objects between the entry support and said intermediate support; and spacing modification means for modifying the spacing of the grouped objects from the entry spacing to the predetermined spacing.

4. The loading system claimed in claim 3 wherein said holding means include separate holding members adapted to take up respective objects from said grouped objects and to move between said entry support and said intermediate support in co-operation with said spacing modification means.

5. The loading system claimed in claim 4 wherein said spacing modification means include guide grooves adapted to guide the respective separate holding members and said guide grooves are disposed in intersecting directions in a common plane.

6. The loading system claimed in claim 4 wherein said separate holding members include suction nozzles.

7. The loading system claimed in claim 6 wherein said holding means include at least one clamp adapted to grasp said grouped objects, said objects are presented in a vertical position in said entry support, and said clamp is adapted to move said grouped objects from said vertical position to a horizontal position.

8. The loading system claimed in 7 wherein said suction nozzles are adapted to take up by suction said grouped objects placed in said horizontal position by said clamp.

9. The loading system claimed in claim 3 wherein said intermediate support includes a circular contour turntable adapted to rotate stepwise and comprising a series of support members for said objects disposed along said circular contour turn-table with a spacing equal to said predetermined spacing.

10. The loading system claimed in claim 9 further comprising orientation means which co-operate with said holding means, said orientation means adapted to orient said objects while moving toward said intermediate support so that said objects are placed on the respective support members with the same orientation relative to the rotation center of said circular contour turntable.

11. The loading system as claimed in claim 3 wherein said holding means are adapted to take up and move liquid crystal display screens.

12. An offloading system for offloading grouped objects, presented at an exit spacing, to an exit support from a transfer system which transfer system in turn transfers each of the grouped objects from a printing table, said offloading system comprising:

an intermediate support adapted to support the grouped objects with a predetermined spacing;

holding means for simultaneously taking up each of the grouped objects and moving the grouped objects between said intermediate support and the exit support; and spacing modification means for modifying the spacing of the grouped objects from the predetermined spacing to the exit spacing.

13. The offloading system claimed in claim 12 wherein said holding means include separate holding members adapted to take up the respective grouped objects and to move between said intermediate support and said exit support in co-operation with said spacing modification means.

14. The offloading system claimed in claim 13 wherein said spacing modification means include guide grooves adapted to guide the respective separate holding members and said guide grooves are disposed in intersecting directions in a common plane.

15. The offloading system claimed in claim 13 wherein said separate holding members include suction nozzles.

16. The offloading system claimed in claim 15 wherein said holding means include at least one clamp adapted to grasp said grouped objects, said objects are presented in a horizontal position, said clamp is adapted to move said grouped objects from said horizontal position to a vertical position, and said objects are presented in said vertical position in said exit support.

17. The offloading system claimed in claim 16 wherein said suction nozzles are adapted to take up by suction said grouped objects placed in a horizontal position on said intermediate support and said clamp is adapted to grasp said grouped objects presented in a horizontal position by said suction nozzles.

18. The offloading system claimed in claim 12 wherein said intermediate support includes a circular contour turntable adapted to rotate stepwise and comprising a series of support members for said objects disposed along said circular contour turn-table with a spacing equal to said predetermined spacing.

19. The offloading system claimed in claim 18 further comprising orientation means which co-operate with said holding means, said orientation means adapted to orient said objects while they are moving toward said exit support so that said objects are placed on said exit support with the same orientation.

20. The offloading system claimed in claim 18 further comprising independent drive means adapted to drive said stepwise rotation of said intermediate support, said rotation moves said support members successively to a transfer station to which said transfer system is adapted to transfer an object, and a sensor adapted to sense an object on said support member at the transfer station and co-operate with said independent drive means so that said turntable of said intermediate support is rotated only if said sensor senses an object on said support member at said transfer station.

21. The offloading system claimed in claim 18 wherein rotation of said intermediate support moves said support members successively to exit stations, the number of exit stations is equal to the number of objects in a group of objects, and further comprising sensors adapted to sense objects on said support members at said exit stations and drive means of said holding means which co-operate with said sensors so that said holding means take up a group of objects placed on said support members at said exit stations only if said sensors sense an object on each of said support members placed at said exit stations.

22. The offloading system as claimed in claim 12 wherein said holding means are adapted to take up and move liquid crystal display screens.

* * * * *